US006003883A

United States Patent [19]

Brenneman

[11] Patent Number: 6,003,883

[45] Date of Patent: Dec. 21, 1999

[54] RECREATIONAL CHAIR CONVERTER DEVICE

[76] Inventor: Daniel C. Brenneman, 730 Royal Glen Dr., Lakeland, Fla. 33813

[21] Appl. No.: 09/030,238

[22] Filed: Feb. 25, 1998

Related U.S. Application Data

[60] Provisional application No. 60/039,059, Feb. 27, 1997.

[51] Int. Cl.[6] ..... B26B 1/04; B25G 3/36

[52] U.S. Cl. ..... 280/30; 280/47.131; 280/79.2; 403/391

[58] Field of Search ..... 280/30, 47.25, 280/79.2, 647, 650, 654, 767, 47.131; 403/389, 391, 396; 297/130, DIG. 4; 248/316.5; 292/305; 24/265 C, 457, 458

[56] References Cited

U.S. PATENT DOCUMENTS

| | | | |
|---|---|---|---|
| 2,821,762 | 2/1958 | Foose | 24/81 |
| 3,891,245 | 6/1975 | Elsas . | |
| 4,376,547 | 3/1983 | Dominko | 280/30 |
| 4,550,925 | 11/1985 | McDonough . | |
| 4,575,113 | 3/1986 | Boudreau . | |
| 4,852,894 | 8/1989 | Dyer . | |
| 4,852,895 | 8/1989 | Moffitt . | |
| 4,934,719 | 6/1990 | DuPont | 280/47.131 |
| 5,113,717 | 5/1992 | Plamper | 74/502.6 |
| 5,184,794 | 2/1993 | Saito | 248/68.1 |
| 5,356,160 | 10/1994 | Urlwin | 280/30 |
| 5,362,079 | 11/1994 | Graham | 280/47.23 |
| 5,364,112 | 11/1994 | Jackson . | |
| 5,492,347 | 2/1996 | Palmeri . | |
| 5,772,223 | 6/1998 | Letourneau | 280/47.131 |

*Primary Examiner*—J. J. Swann
*Assistant Examiner*—Christopher D Bottorff
*Attorney, Agent, or Firm*—B. G. Colley

[57] ABSTRACT

A recreational chair converter is disclosed. The chair converter will convert a folding chair with a U shaped rear support leg from its normal use as a chair to a transport cart. The chair converter is provided with a pair of wheels mounted on an axle and has a pair of elongated segments attached to each other by means of living hinges and bolts. Each segment has two lengthwise grooves so that the pair of segments, when attached together, will form two parallel cylindrical openings which receive and hold the axle equipped with wheels and the rear support leg of a recreational chair. The pair of segments are securely attached to and are completely around the rear tubular leg of a recreational chair. There is also provided a tension strap and buckle which holds the chair securely to said pair of segments and allows the converter device to be used as a transport cart when it is desired.

7 Claims, 4 Drawing Sheets

RECREATIONAL CHAIR CONVERTER DEVICE

CROSS-REFERENCE TO RELATED APPLICATIONS

This application claims the benefit of U.S. Provisional Application No. 60/039,059, filed Feb. 27, 1997.

BACKGROUND OF INVENTION

The present invention relates to a uniquely designed device that will allow most U-leg frame recreational chairs to convert to a transport cart and maintain the usual functions of the recreational chair.

There are several devices in the background art but none that will as easily convert and provide the durability and stability of the present recreational chair converter device.

U.S. Pat. No. 4,934,719 shows a wheeled attachment for lawn chairs that allows their use as a cart wherein there is a lower bracket made with a hook shaped segment which holds the rear leg of a lawn chair. There is also an upper bracket and strap to hold and clamp the top of the lawn chair to the lower bracket. One problem with this design is that the lower bracket can drop off and get lost. The present invention is an improvement over this device in that this invention provides a pair of segments that clamp securely to and become a contiguous part of the leg of the lawn chair.

U.S. Pat. No. 5,364,112 shows a combination lawn chair and cart wherein the chair is provided with a pair of wheel assembles which are attached to the rear legs of a lawn chair.

U.S. Pat. No. 5,492,347 shows a device for attaching wheels to a lawn chair wherein a plate is equipped with an open lip and a closed lip so that the closed lip will hold a pair of wheels and the open lip will removably hold the rear leg of a lawn chair.

Others in the background art have the wheels permanently attached to the structure of the chair to function as a cart and a chair, but this function is limited to that specific use of that chair.

The problems the inventor has observed with the before referenced devices in the background art is that the devices available do not have the capability to securely fasten to the frame of the a recreational chair and they do not provide a reliable and efficient means to convert an existing chair to a transport cart. Devices in the background art that have permanent attached wheels are more expensive and limited to the use of that chair. The recreation chair converter device described herein has many characteristics that allows the user to easily attach the converter device to most U-leg frame recreational chairs for secure and reliable transport of items to a desired location and then use the recreational chair as it was designed, i.e., sitting position(s) and reclining.

SUMMARY OF INVENTION

The invention described in this application is a uniquely designed converter device that securely attaches completely around the tubular U-leg frame of a recreational chair thereby allowing the user of the chair to use the chair as a transport cart. The converter device is constructed of a solid molded material in a unique design to meet the application and structural conversion of traditional U-leg frame recreational chairs.

The converter device has an unique designed molded body with an upper and lower segments, which has a living hinge, on one side, but it is possible to have both segments open to allow for use with other types of recreational chair configurations. The living hinge allows both body segments to remain attached and the body segments to open in a "clam type" fashion to accept the tubular frame of the chair and the axle and wheels provided with the converter device. The converter device completely encompasses the U-leg frame of the recreational chair and is secured with locking nuts in two areas of the device. The converter device with the axle and wheels is then swiveled back against the U-leg frame of the recreational chair for normal use.

An adjustable tension strap runs through the converter device to the top of the back rest. For chairs with material covering the top of the backrest, a commercially available molded "J" hook is provided. The tension strap secured in this position restricts the back from accidentally folding forward while loading, unloading and transporting. The tension strap buckle can be simply released to use the normal other positions of the recreational chair.

DESCRIPTION OF THE PREFERRED EMBODIMENTS

Figure 1:
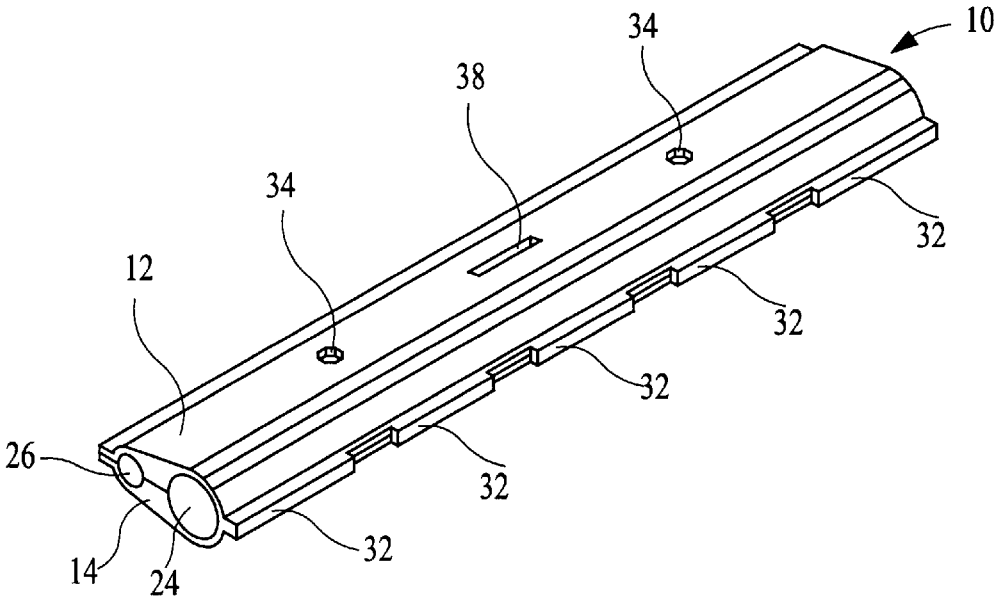
FIG. 1. A perspective view of the converter device in the closed position.
Figure 2:
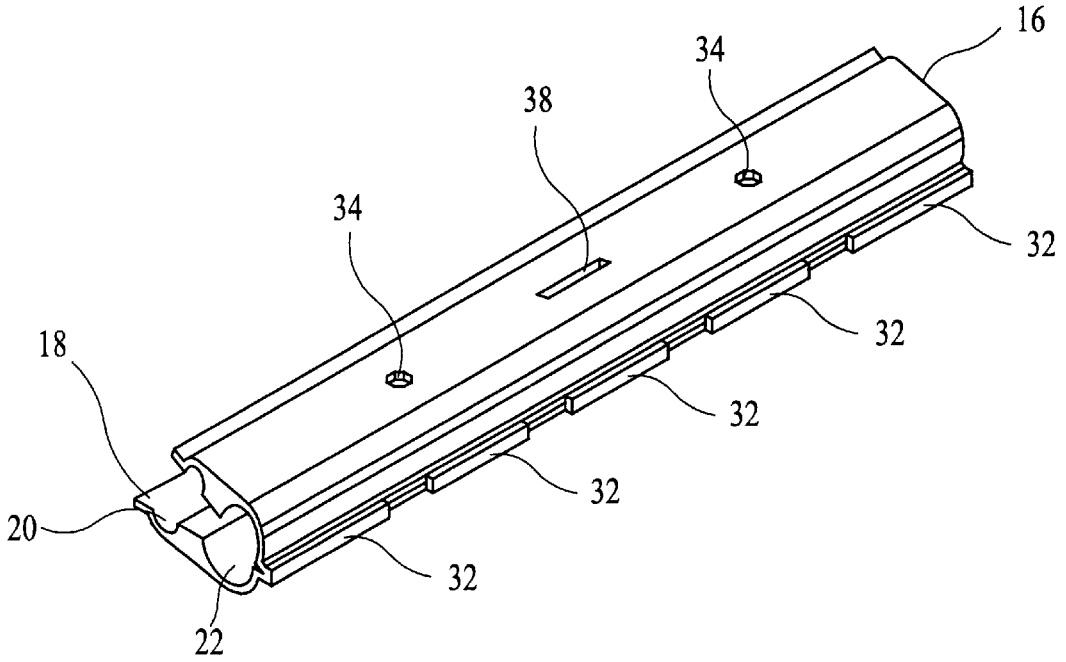
FIG. 2. A perspective view of the converter device in the open position pivoting on the living hinge.
Figure 3:
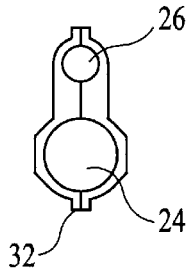
FIG. 3. An end view of the converter device in the closed position.
Figure 4:
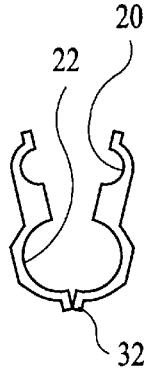
FIG. 4. An end view of the converter device in the open position pivoting on the living hinge.
Figure 5:
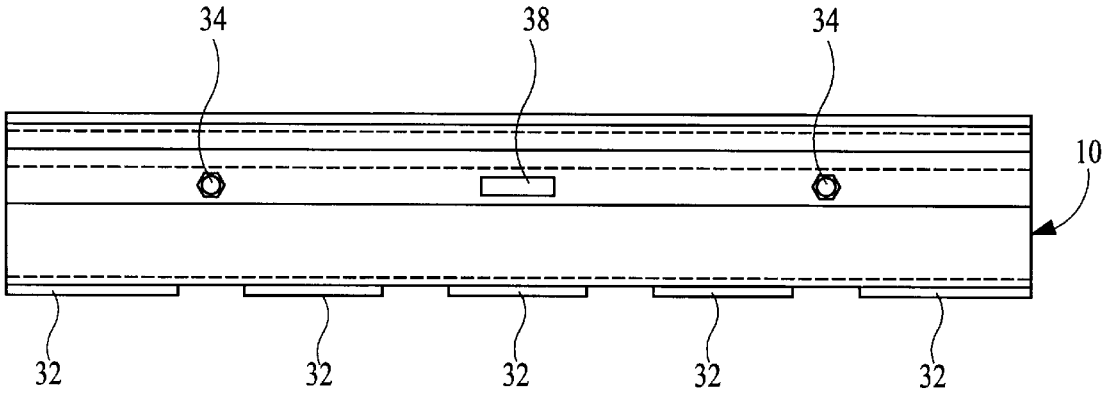
FIG. 5. A top plan view of the converter device, the lower segment is a mirror image of the upper segment view.
Figure 6:
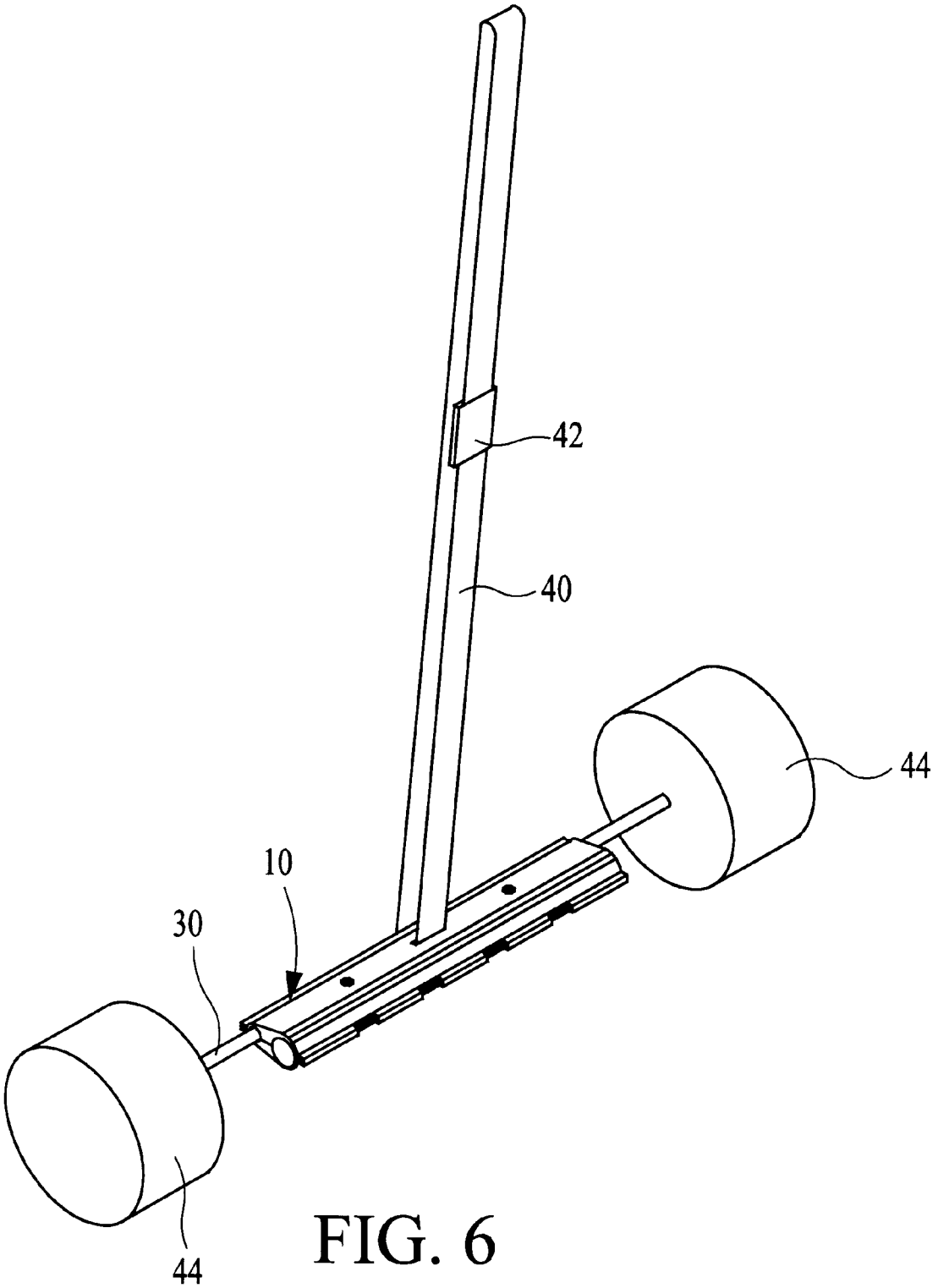
FIG. 6. A perspective view of the converter device with the axle and wheels in place in the converter device and the tension strap extended.

Referring more specifically to the drawings, FIGS. 1–7 detail the various features of the recreational chair converter device. As shown in FIG. 1, the converter device has a body 10 that is comprised of an upper segment 12 and a lower segment 14 that are mirror images of each other. The invention contemplates that the segments are constructed of a solid molded or contoured material, such as plastic, metal or other suitable materials. Each segment has an outer side 16 and an inner side 18. On the inner side of each segment there are two channels 20 and 22 that extend through the length of the segments. These channels are in a semicircular shape. One of the channels 20 is located on one side of each segment and the other channel 22 is located on the other side of each segment. When the upper segment is placed on the lower segment, the channels form cylindrical openings 24 and 26 that run the length of the of the body. One of the cylindrical openings 24 is larger than the other cylindrical opening 26. The larger cylindrical opening is used to accommodate the rearmost horizontal leg/support bar of a recreational chair 28 (FIG. 7), which normally rests flat on a surface such as a deck, ground or sand. When the body of the converter device is attached to a recreational chair, the horizontal bar of the chair is enclosed within the larger opening. The smaller opening is used to accommodate an axle 30 (FIG. 6).

In the preferred embodiment depicted in FIGS. 1–7, the upper segment and lower segment are attached on one side by a living hinge 32. This hinge allows the upper segment to be opened from the lower segment so that the body of the converter device can be fitted completely around the horizontal bar of the chair and the axle as described. The invention contemplates that the converter device could be utilized without a living hinge for other chair configurations.

The upper segment and the lower segment of the body also have two holes 34 molded through the segments to accommodate bolts. The upper segment's bolt holes are molded to hold the bolt head in place, thereby eliminating the need for a tool. The invention contemplates that the head or shaft of the bolt juxtaposed to the head has a configured shape. The holes are positioned in the same places on both segments so that the bolts can be inserted through both segments and secured with a nut, preferably a wing nut.

The upper and lower segments each have a molded slot 38 in them. These slots are also positioned at the same place in both segments. The openings in the slots allow a tension strap 40 to be inserted through each slot. The tension on the tension strap is maintained by a tension strap buckle 42.

Figure 7:
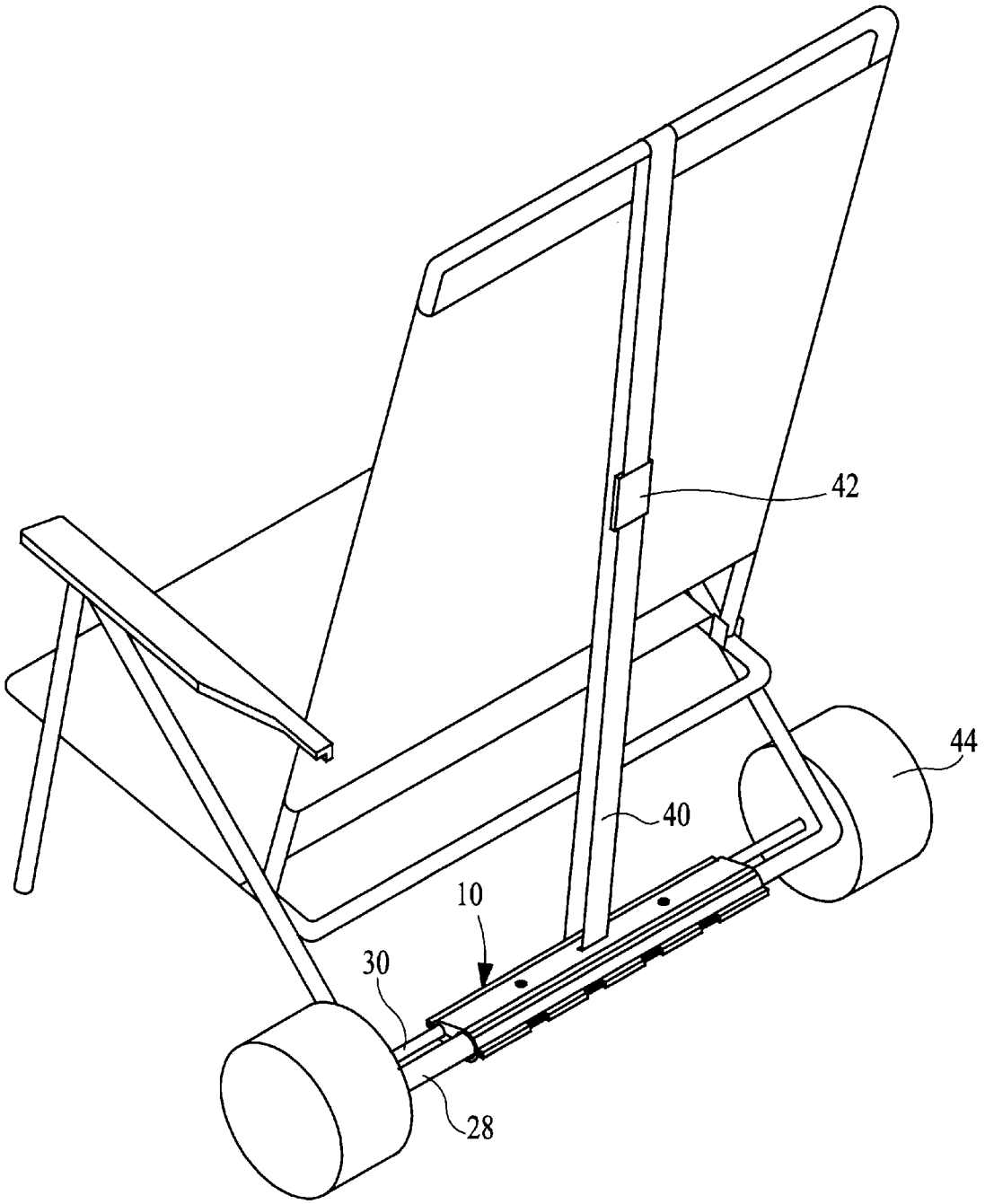
FIG. 7. A perspective view of the converter device as attached to a typical U-leg frame recreational chair.

The converter device also includes wheels 44 that are positioned on each end of the axle. The wheels are attached to the axle by tension caps or other such suitable attaching means. FIG. 7 shows the converter device affixed to a typical recreational chair. The converter device is swiveled back to the underside of the U-leg frame of the chair and secured at this point to the top of the back support frame of the recreational chair with the tension strap. When the converter device is attached to the chair frame and with the tension strap secured, a recreational chair may be used as a transport cart. This integrity of the components allows the user to transport items freely to and from the recreational area. An important feature of the converter device is that it can remain on the recreational chair and be stored for the next use or the converter device can easily be removed and affixed to other U-leg frame recreational chairs as the user desires.

I claim:

1. A recreational chair converter device which comprises a pair of elongated segments attached to each other by living hinges and bolts wherein each segment has two lengthwise grooves therein so that said pair forms two parallel cylindrical openings which are adapted to receive (a) an axle equipped with wheels and (b) the rear support leg of a recreational chair.

2. A chair converter as set forth in claim 1 wherein said pair of segments are molded plastic.

3. A chair converter as set forth in claim 1 wherein said pair of segments are molded plastic and said segments are provided with bolt holes molded to hold the bolt head in place.

4. In a recreational chair assembly comprising a folding chair having a U shaped rear support leg, a pair of wheels mounted on an axle, the improvement which comprises a pair of elongated segments attached to each other by living hinges and bolts wherein each segment has two lengthwise grooves therein so that said pair forms two parallel cylindrical openings which are adapted to receive and hold said axle equipped with wheels and the rear support leg of a recreational chair and strap means which hold said chair securely to said pair of segments.

5. A chair assembly as set forth in claim 4 wherein said strap means is a tension strap and buckle system.

6. A chair assembly as set forth in claim 4 wherein said pair of segments are molded plastic.

7. A chair converter as set forth in claim 4 wherein said pair of segments are molded plastic and said segments are provided with bolt holes molded to hold the bolt head in place.

* * * * *